US009016000B2

(12) United States Patent
Elliott et al.

(10) Patent No.: US 9,016,000 B2
(45) Date of Patent: Apr. 28, 2015

(54) HOTEL ROOM THAT INCLUDES BOTH LIVING SPACES AND FITNESS SPACES

(71) Applicant: Six Continents Hotels, Inc., Atlanta, GA (US)

(72) Inventors: Gavin Elliott, Amsterdam (NL); Bart Lans, Amsterdam (NL); George Gottl, Amsterdam (NL); Oliver Michell, Amsterdam (NL); Chun Wai Cheung, Amsterdam (NL)

(73) Assignee: Six Continents Hotels, Inc., Atlanta, GA (US)

( * ) Notice: Subject to any disclaimer, the term of this patent is extended or adjusted under 35 U.S.C. 154(b) by 0 days.

(21) Appl. No.: 13/780,635

(22) Filed: Feb. 28, 2013

(65) Prior Publication Data

US 2013/0219816 A1 Aug. 29, 2013

Related U.S. Application Data

(60) Provisional application No. 61/604,143, filed on Feb. 28, 2012.

(51) Int. Cl.
*E04H 3/02* (2006.01)

(52) U.S. Cl.
CPC ..... *E04H 3/02* (2013.01)

(58) Field of Classification Search
USPC ..... 52/79.1, 169.6, 177
See application file for complete search history.

(56) References Cited

U.S. PATENT DOCUMENTS

| | | | | |
|---|---|---|---|---|
| 3,923,134 | A * | 12/1975 | Rezazadeh | 194/241 |
| 5,230,674 | A * | 7/1993 | Terauds | 482/52 |
| 5,787,655 | A * | 8/1998 | Saylor | 52/181 |
| 5,813,947 | A * | 9/1998 | Densmore | 482/51 |
| 6,206,812 | B1 * | 3/2001 | Nizamuddin | 482/131 |
| 6,248,048 | B1 * | 6/2001 | Zuckerman et al. | 482/142 |
| 6,692,417 | B2 * | 2/2004 | Burrell | 482/142 |
| 2003/0226323 | A1 * | 12/2003 | Travez et al. | 52/220.7 |
| 2011/0166005 | A1 * | 7/2011 | Cicco | 482/140 |
| 2012/0028770 | A1 * | 2/2012 | Barchi | 482/131 |

FOREIGN PATENT DOCUMENTS

JP 2003129681 A * 5/2003 ..... E04H 3/02

* cited by examiner

*Primary Examiner* — Brian Glessner
*Assistant Examiner* — Adam Barlow
(74) *Attorney, Agent, or Firm* — Kilpatrick Townsend & Stockton LLP

(57) ABSTRACT

A hotel room that serves as guest accommodations and provides a fitness area for a guest. The hotel room includes different zones, at least one of which is a sleeping zone, and at least the other of which can serve a fitness function. The fitness zone may be convertible between living spaces and fitness, or may serve only a fitness function.

13 Claims, 1 Drawing Sheet

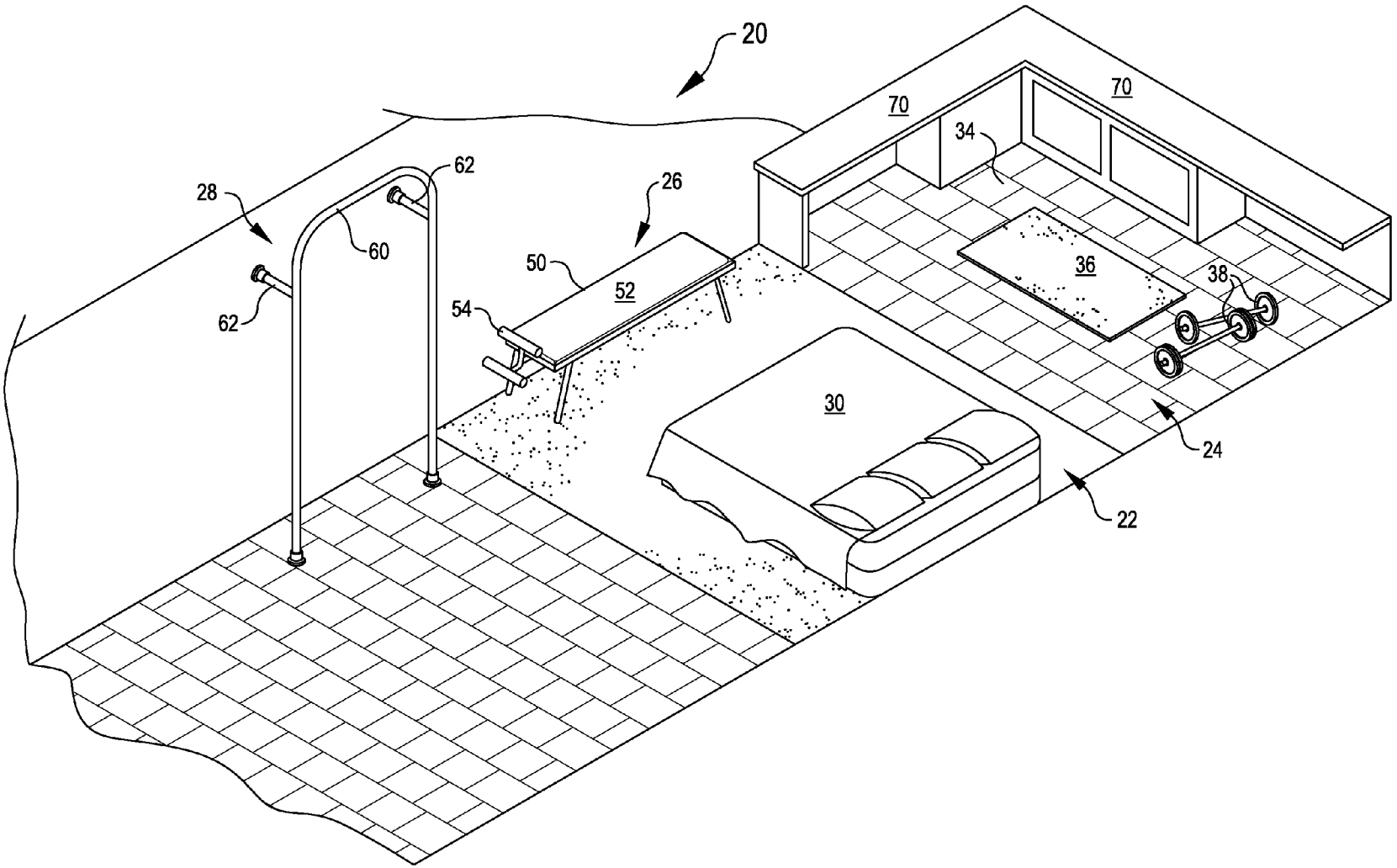
20
22
24
26
28
30
34
36
38
50
52
54
60
62
62
70
70

HOTEL ROOM THAT INCLUDES BOTH LIVING SPACES AND FITNESS SPACES

CROSS-REFERENCES TO RELATED APPLICATIONS

The present application claims the benefit of U.S. Provisional Application No. 61/604,143, filed on Feb. 28, 2012, the full disclosure of which is incorporated herein by reference.

BACKGROUND

Hotels are establishments that provide lodging, meals, entertainment, and various personal services for the public. Many modern hotels include full service restaurants, swimming pools, fitness centers, business centers, childcare, conference facilities, and social function services. Most modern hotels include a fitness center. An issue with the fitness center is safety, or at least perceived safety or privacy for patrons, particularly in off-peak hours. Often, a hotel guest may feel uncomfortable working out in a fitness room with only one other person. In the later hours of the day or the earlier hours of the morning, when the fitness center may have little traffic, a hotel guest may find himself or herself working out with only one other person. This sharing of a fitness center without supervision or the comfort of others may be uncomfortable for some guests.

Although security measures can be taken, such as having a camera in a workout area, the camera may not provide the same comfort as having fitness personnel or other individuals present. However, due to the light traffic during these times and the need to limit hotel costs, it is not practical to place hotel staff in the fitness center.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with embodiments, a hotel room is provided that includes both living spaces and workout spaces. Thus, in accordance with embodiments, a hotel guest may choose to workout in his or her room, utilizing the spaces and structures provided in the room. Some of the workout areas may be permanently structured for workout, may be configured for dual use for workout or living spaces, or may be rearranged for alternate use between a workout configuration and a living configuration.

In embodiments, a floor workout zone is provided in the room. This floor workout zone can be used for yoga, workout with dumbbells, or other floor exercises. A yoga mat, dumbbells, or other exercise equipment may be provided for use in this area. When the user is done with the workout, the yoga mat and dumbbells can be put away, allowing the space to be used for living space instead of workout space.

In accordance with additional embodiments, a bench is provided in the room that includes leg locks so that a user may work out on the bench, including locking the user's legs into the bench and doing sit ups. The bench includes a leather or synthetic leather covering so that it may be easily cleaned during or after workouts. The bench not only provides workout features, but also can be used during a conventional hotel guest's stay. For example, the bench may be used for a luggage stand or for sitting while the hotel guest is dressing, for example, while putting on shoes.

In accordance with additional embodiments, a dual purpose bar is provided in the hotel room. This dual purpose bar can be used for both the hanging of clothes and as a chin-up or pull-up bar for the hotel guest. The dual purpose bar includes sufficient structural support to support the hotel guest.

For a fuller understanding of the nature and advantages of the present invention, reference should be made to the ensuing detailed description and accompanying drawings.

BRIEF DESCRIPTION OF THE DRAWINGS

FIG. 1 shows an isometric view of a guest hotel room having workout features in accordance with embodiments.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

In accordance with embodiments, a hotel room is provided having various workout functions provided in the room. Thus, the room is usable both for traditional hotel accommodations and as a workout space for the hotel guest.

In embodiments, the hotel room is divided into multiple zones, separating sleeping and living areas from workout zones, but also having zones that have a dual purpose for hotel room accommodations and workout.

The workout zones of the room are provided with materials and mats or other equipment that permit the areas to be easily cleaned. Moreover, the spaces are clearly removed from sleeping areas of the room. These features provide a guest comfort, while providing working out and living spaces within the same room.

Referring now to FIG. 1, a hotel guest room 20 is shown having guest accommodations, amenities and workout features. The room 20 includes multiple zones, including a sleeping zone 22, a floor workout zone 24, a bench zone 26, and a closet zone 28.

The sleeping zone 22 includes a bed 30 and night stands, clocks, radios or other features that are commonly found in hotel guest accommodations. This sleeping zone 22 may include, for example, carpet flooring or other conventional flooring material.

The floor workout zone 24 is spaced from the sleeping zone 22 and will typically include a tiled or other easily cleanable floor. As an alternative to the tile shown in the floor workout zone 24, sports flooring, such as NEOFLEX #817 sports flooring, can be provided in the floor workout zone 24. Other synthetic or natural sports flooring could be used in the floor workout zone 24. The different floor covering in the floor workout zone 24 relative to the other spaces in the room provides not only a feel of a workout area, but also delineates the workout area from the sleeping zone 22 of the room 20. In embodiments, the floor workout zone 24 includes a yoga mat 36 that can be stored in a convenient location, such as at the end of the floor workout zone 24. Dumbbell weights 38 or other exercise equipment may be provided in the floor workout zone. The dumbbell weights 38 and the yoga mat 36 may be put away, and the floor workout zone 24 is then available for typical hotel guest amenities, such as use of a desk 70 and office area.

The bench zone 26 includes a dual purpose bench 50. The dual purpose bench 50 includes a flat workout surface 52 with leg locks 54 at one end. The bench 50 is with a material that is easily cleaned and that is associated with working out, such as leather or a synthetic leather material. The bench 50 may be used by a hotel guest for exercises, for example with the dumbbell weights 38, or for doing sit-ups or other calisthenics. For sit-ups, the user may lock his or her legs into the leg locks 54 in a manner known in the exercise bench art, and may perform sit-ups on the bench.

The dual purpose bench 50 also serves functions for typical hotel room accommodations. For example, the bench surface 52 may be used as a luggage stand. A hotel guest may also sit on the surface 52 while getting dressed or when talking on the phone, as examples.

The closet zone 28 includes a dual purpose bar 60. In the embodiment shown in the drawings, the dual purpose bar is an inverted U-shape, attached to the floor at its distal, lower ends. The dual purpose bar 60 includes structural supports 62 extending rearwardly to a wall. The supports 62 prevent the dual purpose bar from moving, and provide hanging space for clothes or other items. The structural supports 62 suspend the bar 60 into the room a sufficient amount so that a hotel guest may use the dual purpose bar 60 as a chin-up or pull-up bar. In addition to the structural supports 62, the dual purpose bar 60 may be used for hanging of clothes or other items.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A hotel room, comprising: a sleeping zone having a first floor covering material and including a bed; and at least one fitness zone that is usable for both hotel room use and fitness use, wherein the at least one fitness zone includes a floor workout zone comprising a second floor covering material that is different than the first flooring material, and the at least one fitness zone further including:

a bench zone comprising a bench, the bench configured to serve as a workout bench and including leg locks at one end of the bench configured for locking a user's legs while doing sit ups, wherein the sleeping zone and the at least one fitness zone are in the same room.

2. The hotel room of claim 1, wherein the at least one fitness zone includes a pull-up bar comprising a plurality of support members fixedly attached to at least one of a wall or a floor of the hotel room.

3. The hotel room of claim 1, wherein said at least one fitness zone comprises a closet zone having a pull-up bar, wherein the pull-up bar is configured to serve as a clothes rack.

4. The hotel room of claim 1, wherein the floor workout zone includes a desk.

5. The hotel room of claim 1, wherein the floor workout zone comprises a yoga mat and exercise weights.

6. The hotel room of claim 1, wherein the second floor covering material includes a synthetic rubber sports flooring material.

7. A hotel room, comprising: guest accommodations including a sleeping area with at least a bed; and at least one fitness zone that is adjacent to the sleeping area and that is usable for both hotel room use and fitness use, wherein the at least one fitness zone includes a floor workout zone including a workout area with a synthetic rubber sports flooring material that is different than a flooring material of the sleeping area, and at least one of:

a bench zone comprising a bench, the bench configured to serve as a workout bench, and a pull-up bar fixedly attached to at least one of a wall of the hotel room or a floor of the hotel room, and configured to support a guest's weight.

8. The hotel room of claim 7, comprising the bench zone and the bench, wherein said bench is further configured to serve as a luggage stand.

9. The hotel room of claim 7, comprising the bench zone and the bench, wherein the bench comprises leg locks at one end of the bench configured to hold a user's legs while the user doing sit ups.

10. The hotel room of claim 7, comprising the pull-up bar, wherein said pull-up bar is fixedly attached to the wall of the hotel room and the floor of the hotel room.

11. The hotel room of claim 9, further comprising a desk at least partially surrounding the floor workout zone.

12. The hotel room of claim 1, wherein the at least one fitness zone includes, and a closet zone including a pull-up bar, and the floor workout zone and the closet zone are at least partially separated by the sleeping zone.

13. The hotel room of claim 7, comprising the pull-up bar and the bench zone with the bench.

* * * * *